US005511270A

United States Patent [19]

Eliachar et al.

[11] Patent Number: 5,511,270

[45] Date of Patent: Apr. 30, 1996

[54] HAIR BRUSH

[76] Inventors: Eliahu Eliachar, 25 Yefe Nof Street, Haifa 34371; Omri Rothschild, 4 Abraham Lev Street, Tel Aviv 64284; Roni Raviv, 7 Maccabi Street, Ness Ziona 70400, all of Israel

[21] Appl. No.: 329,468

[22] Filed: Oct. 26, 1994

[51] Int. Cl.[6] ..... A46B 13/02

[52] U.S. Cl. ..... 15/22.1; 601/72

[58] Field of Search ..... 15/22.1, 22.2, 15/97.1; 601/70, 72

[56] References Cited

U.S. PATENT DOCUMENTS

| | | | |
|---|---|---|---|
| 2,489,582 | 11/1949 | McCready | 15/22.1 |
| 2,676,347 | 4/1954 | Hershey | 15/22.1 |
| 2,806,235 | 9/1957 | Carstairs et al. | 15/22.1 |
| 3,160,902 | 12/1964 | Aymar | 15/22.1 |
| 3,358,309 | 12/1967 | Richardson | 15/22.1 |
| 3,427,674 | 2/1969 | Tone et al. | 15/23 |
| 4,292,986 | 10/1981 | Ergaver et al. | 132/11 R |
| 4,656,684 | 4/1987 | Jewett | 15/27 |
| 5,247,218 | 9/1993 | Sven | 310/81 |
| 5,253,382 | 10/1993 | Beny | 15/22.1 |

FOREIGN PATENT DOCUMENTS

| | | | |
|---|---|---|---|
| 1216838 | 7/1961 | Canada | 15/22.1 |

*Primary Examiner*—Edward L. Roberts, Jr.
*Attorney, Agent, or Firm*—Limbach & Limbach; W. Patrick Bengtsson

[57] ABSTRACT

An electrically powered vibrating hair brush including an electric vibratory drive, a handle portion, and a brush head portion driven by the vibratory drive, the brush head portion being non-fixedly mounted onto the handle portion about a longitudinal axis, so as to permit both relative axial movement along the longitudinal axis and relative rotational movement thereabout.

15 Claims, 4 Drawing Sheets

30
2

30
4

3
4
2
1
30

34
40
18
12
20
20
3
1

HAIR BRUSH

FIELD OF THE INVENTION

The present invention relates to hair care apparatus and more particularly to hair brushes.

BACKGROUND OF THE INVENTION

Hair brushing, particularly when children are involved, is often a tiring and unpleasant task. This is particularly true when the hair contains knots and tangles, which must be worked out patiently by hand.

Various types of electrically powered hair brushes and other personal care brushes are known in the patent literature. The following U.S. Pat. Nos. are believed to represent the current state of the art: 5,253,382; 5,247,218; 4,656,684; 4,292,986; 3,427,674; 2,806,235 and 2,676,347.

SUMMARY OF THE INVENTION

The present invention seeks to provide an improved electrically powered hair brush.

There is thus provided in accordance with a preferred embodiment of the present invention an electrically powered vibrating hair brush including an electric vibratory drive, a handle portion, and a brush head portion driven by the vibratory drive, the brush head portion being non-fixedly mounted onto the handle portion about a longitudinal axis, so as to permit both relative axial movement along the longitudinal axis and relative rotational movement thereabout.

Additionally in accordance with a preferred embodiment of the present invention the brush head portion includes a base portion which lies generally in a plane and a multiplicity of bristles which extend outwardly from the base portion, generally perpendicular to the plane.

Further in accordance with a preferred embodiment of the present invention the electric vibratory drive is operative to provide vibration of the brush head portion both in the plane and in a plane perpendicular thereto and perpendicular to the longitudinal axis.

Still further in accordance with a preferred embodiment of the present invention the electric vibratory drive includes a rotating eccentric drive operative to produce travel of the brush head portion relative to the handle portion along a three-dimensional travel path.

Additionally in accordance with a preferred embodiment of the present invention the rotating eccentric drive has an axis of rotation which substantially intersects the longitudinal axis.

Further in accordance with a preferred embodiment of the present invention the electrically powered vibrating hair brush also includes an electrical power source located in the handle portion.

Still further in accordance with a preferred embodiment of the present invention the electrically powered vibrating hair brush also includes an electrical power source located in the brush head portion.

Additionally in accordance with a preferred embodiment of the present invention the electrically powered vibrating hair brush also includes a biasing apparatus disposed between the brush head portion and the handle portion for absorbing vibration forces produced by the vibrating brush head portion and at least partially preventing the vibration forces from being applied to the handle portion.

Further in accordance with a preferred embodiment of the present invention the biasing apparatus is fixedly attached at one end to the brush head portion and fixedly attached at the other end to the handle portion.

Still further in accordance with a preferred embodiment of the present invention the biasing apparatus includes a spring.

Additionally in accordance with a preferred embodiment of the present invention the spring includes a helical coil spring.

Further in accordance with a preferred embodiment of the present invention the spring includes an elastomeric material.

Additionally in accordance with a preferred embodiment of the present invention the electrically powered vibrating hair brush also includes a relative displacement limiter for limiting at least one of the relative axial movement along the longitudinal axis and the relative rotational movement thereabout.

Still further in accordance with a preferred embodiment of the present invention the electrically powered vibrating hair brush also includes a relative displacement limiter for limiting both of the relative axial movement along the longitudinal axis and relative rotational movement thereabout.

Additionally in accordance with a preferred embodiment of the present invention the biasing apparatus is operative to center the relative displacement limiter in the absence of the vibration forces.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1B:
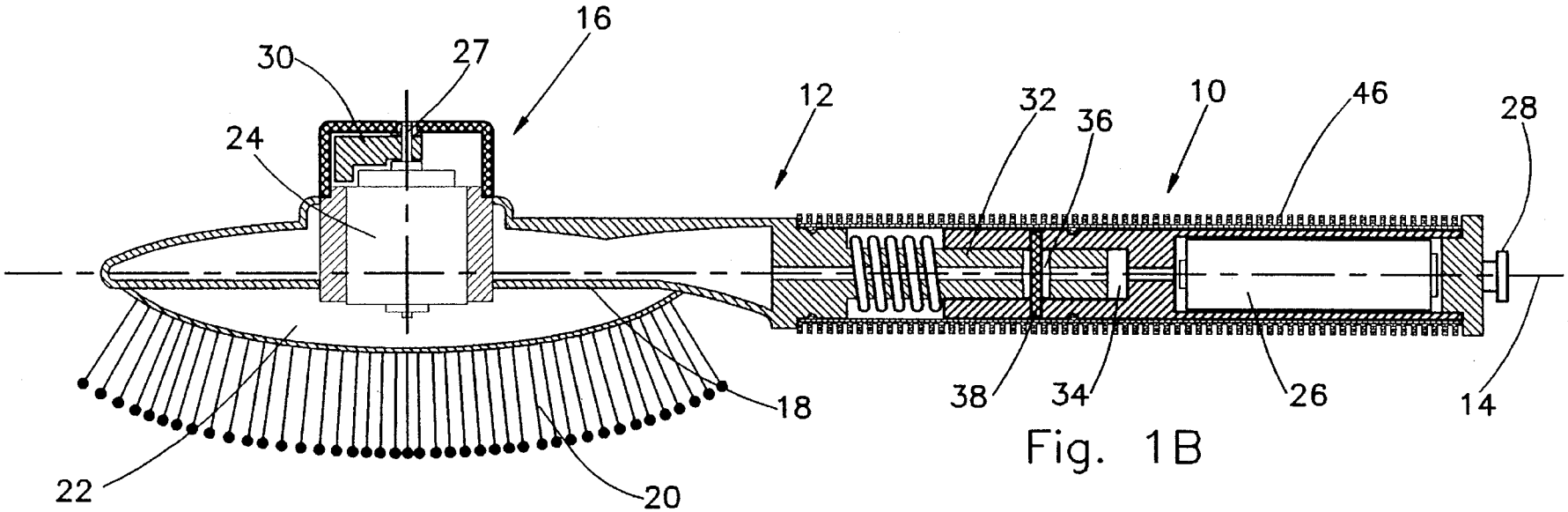
FIGS. 1A and 1B are simplified, partially cut-away respective top view and side view illustrations of an electrically powered vibrating hair brush constructed and operative in accordance with a preferred embodiment of the present invention.

Reference is now made to FIGS. 1A–3B, which illustrate an electrically powered vibrating hair brush constructed and operative in accordance with a preferred embodiment of the present invention and comprising a handle portion 10 and a brush head portion 12. In accordance with a preferred embodiment of the present invention, the brush head portion 12 is non-fixedly mounted onto the handle portion 10 about a longitudinal axis 14, so as to permit both relative axial movement along said longitudinal axis and relative rotational movement thereabout.

Further in accordance with a preferred embodiment of the present invention an electric vibratory drive 16 is provided and is preferably mounted onto the brush head portion 12.

In accordance with a preferred embodiment of the present invention, the brush head portion 12 comprises a base portion 18, which lies generally in a plane, and a multiplicity of bristles 20, which extend outwardly from the base portion, generally perpendicular to the plane thereof. In the illustrated embodiment, the bristles 20 may be mounted on a generally convex bristle support member 22, which is in turn, mounted on the base portion 18. In this case, the bristles 20 are still considered to extend generally perpendicular to the plane of base 18.

In the illustrated embodiment of the invention, the electric vibratory drive 16 comprises an electric motor 24, fixedly mounted in the base portion 18 and is powered by a battery 26 located in handle portion 10 and connected thereto by electrical wiring (not shown) via an on/off switch 28. The on/off switch 28 may be located on the handle portion 10 as shown or alternatively may be located at any other suitable location on the brush, such as on base portion 18.

Electric motor 24 has an output shaft 27, the axis of which preferably is substantially perpendicular to, and substantially coplanar with, longitudinal axis 14. Preferably, output shaft 27 also is substantially perpendicular to the plane of base portion 18. Mounted onto output shaft 27 for rotation therewith in a plane substantially parallel to the plane of the base portion 18 is an eccentric weight 30, which is operative to cause vibration of the brush head portion 12 both axially along axis 14 and rotationally thereabout in a three-dimensional travel path.

Figures 2A, 2B, 3A, 3B:
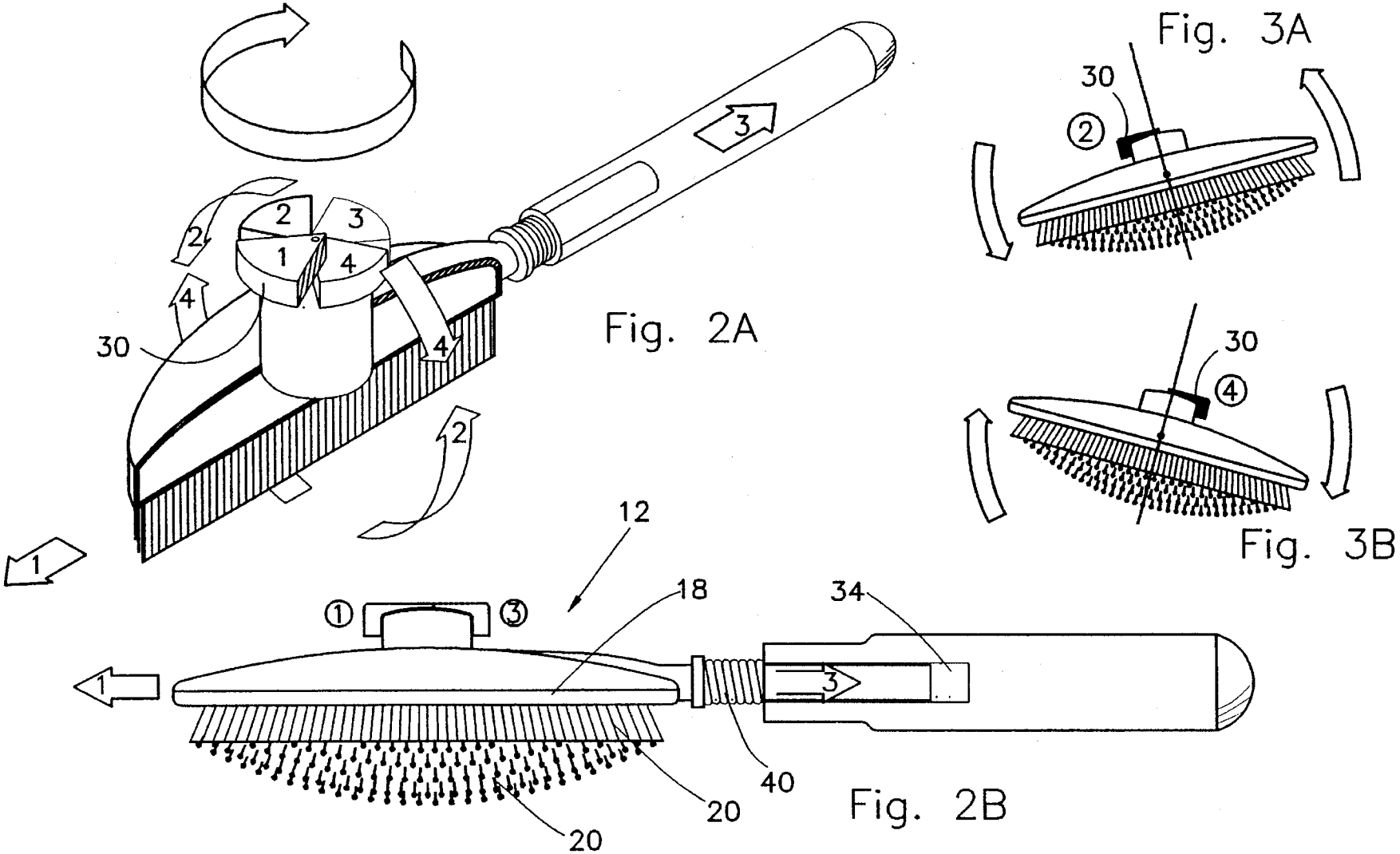
FIGS. 2A and 2B are simplified, partially cut-away respective pictorial and side view illustrations of the electrically powered vibrating hair brush of FIGS. 1A and 1B showing axial and transverse rotational motion thereof.
FIGS. 3A and 3B are simplified front view illustrations of the brush of FIGS. 1A–2B in two mutually rotated orientations.

The operation of the rotating weight 30 in producing both axial and rotational motion of the brush head portion 12 with respect to axis 14 may be understood from a consideration of FIGS. 2A–3B. It is seen that eccentric weight 30, as it rotates with the output shaft 27, may pass through four general positions, here numbered for convenience as 1, 2, 3 and 4. When weight 30 is located in position 1, as seen in FIGS. 2A and 2B, it pulls the brush head portion 12 forward as indicated by arrow 1. Similarly, when weight 30 is located in position 3, it pulls the brush head portion 12 rearward as indicated by arrow 3.

When the weight 30 is at positions 2 or 4, it lies off-axis with respect to longitudinal axis 14 (FIG. 1B) and thus causes rotation of the brush head portion 12 about axis 14, as seen particularly in FIGS. 3A and 3B. The combined axial and rotational motion of the brush head portion defines motion in a repeating three dimensional travel path, which is believed to be particularly useful for detangling hair.

The mounting construction whereby the brush head portion 12 is free to vibrate relative to the handle portion 10 may be realized in a number of possible ways. In the illustrated embodiment, a shaft 32 is fixed to the brush head portion 12 and extends axially along axis 14, slidably and rotatably mounted in a socket 34 formed in the handle portion 10. Shaft 32 is preferably formed with a transverse bore 36 for loosely accommodating a retaining pin 38.

Retaining pin 38 extends through handle portion 10 and is fixedly attached thereto. The relative dimensions of pin 38 and of bore 36 determine the amount of relative motion between the brush head portion 12 and the handle portion 10 under vibration and thus the engagement of the pin 38 with bore 36 effectively limits the amplitude of both rotational and axial vibration of the brush head portion 12 relative to the handle portion 10.

In accordance with a preferred embodiment of the present invention a spring 40 is disposed about shaft 32 between the brush head portion 12 and the handle portion 10 for absorbing vibration forces produced by the vibrating brush head portion and at least partially preventing them from being applied to the handle portion 10. Spring 40, which is preferably fixedly attached at a brush end 42 to brush head portion 12 and at a handle end 44 to handle portion 10, also centers pin 38 relative to bore 36 in the absence of the forces produced by rotation of the eccentric weight 30 and other external forces.

A flexible sleeve 46 may be mounted onto the handle portion 10 and the brush head portion 12 so that the region between the brush head portion 12 and the handle portion 10 is generally covered. The dimensions of the sleeve 46, the handle portion 10 and the brush head portion 12 are such that the flexible sleeve 46 is operative to prevent the intrusion of liquids of other foreign matter into the brush head portion 12 and the handle portion 10. The flexible sleeve 46 is not shown in FIG. 1A for the sake of clarity.

It will be appreciated by one normally skilled in the art that shaft 32 may be formed integrally with the brush head portion 12.

Figure 1A:
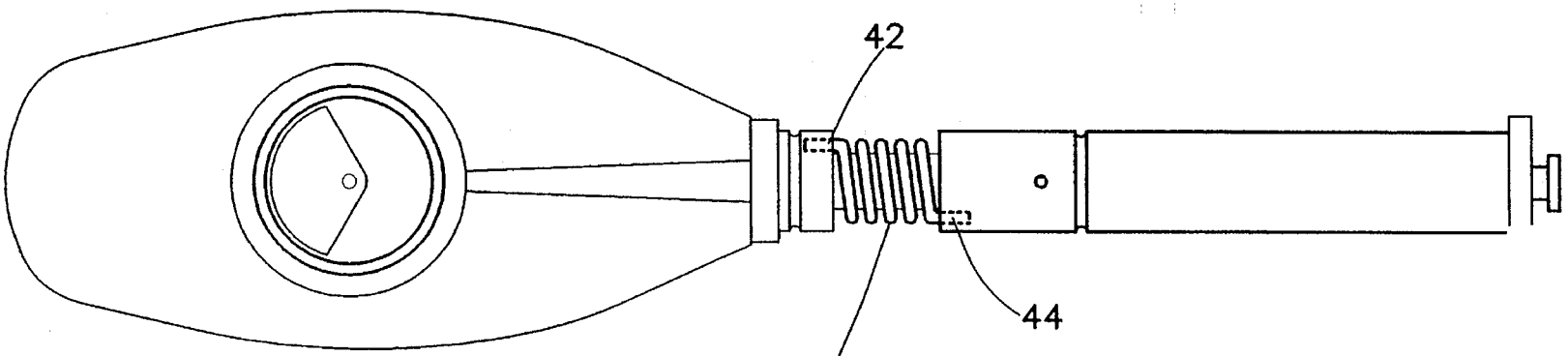
Figure 4B:
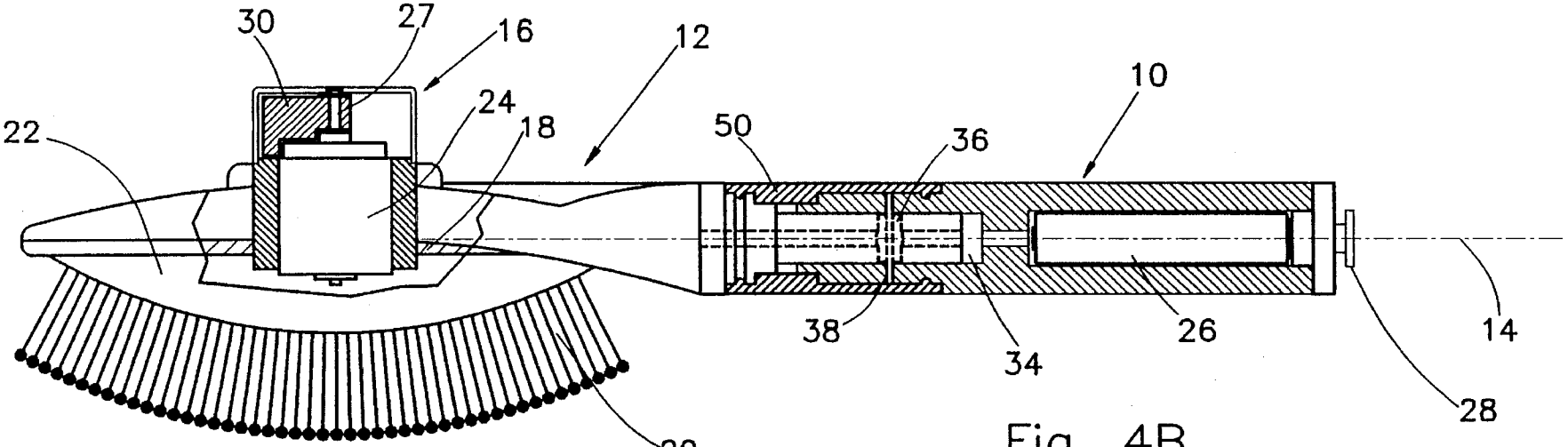
FIGS. 4A and 4B are simplified, partially cut-away respective top view and side view illustrations of an electrically powered vibrating hair brush constructed and operative in accordance with an alternative embodiment of the present invention.
Figure 4A:
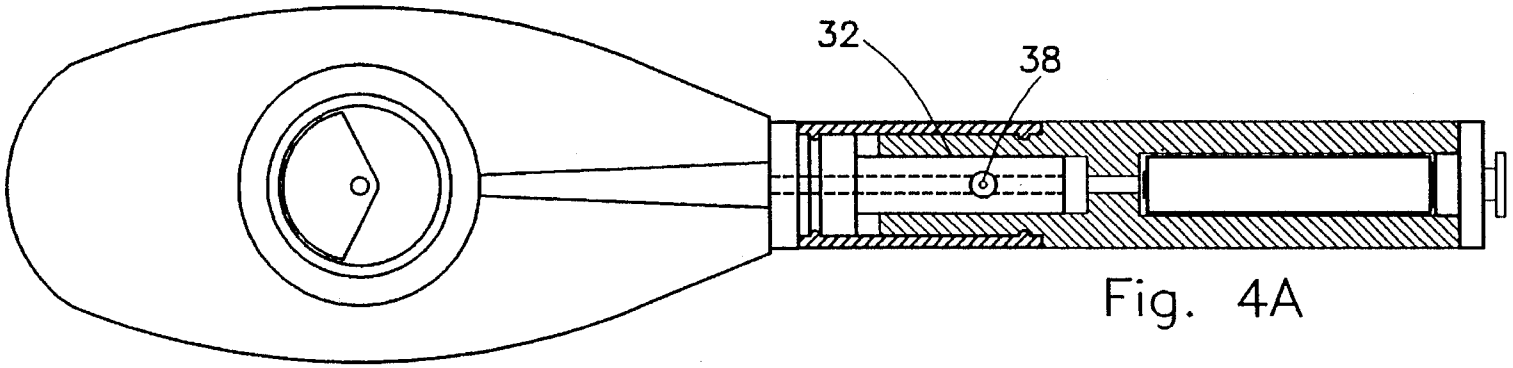

Reference is now made to FIGS. 4A and 4B, which may be identical to the embodiment of FIGS. 1A and 1B except that a rubber spring 50 is disposed about shaft 32 between the brush head portion 12 and the handle portion 10 for absorbing vibration forces produced by the vibrating brush head portion and at least partially preventing them from being applied to the handle portion 10.

Figure 4D:
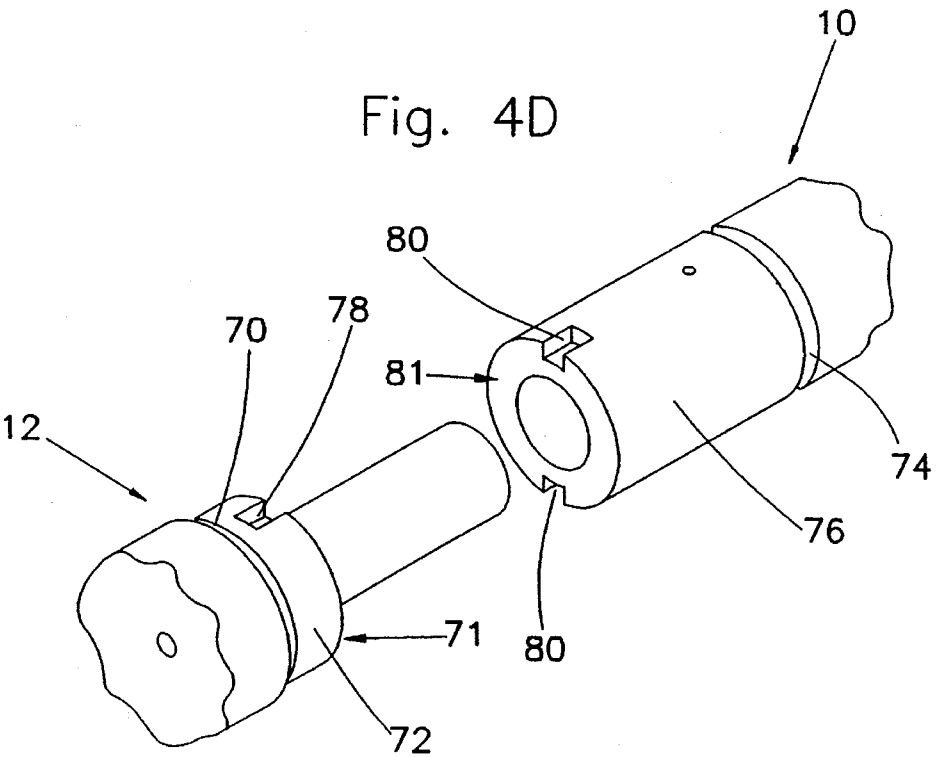
FIG. 4D is a pictorial illustration of the part of the apparatus illustrated in FIG. 4C.
Figure 4C:
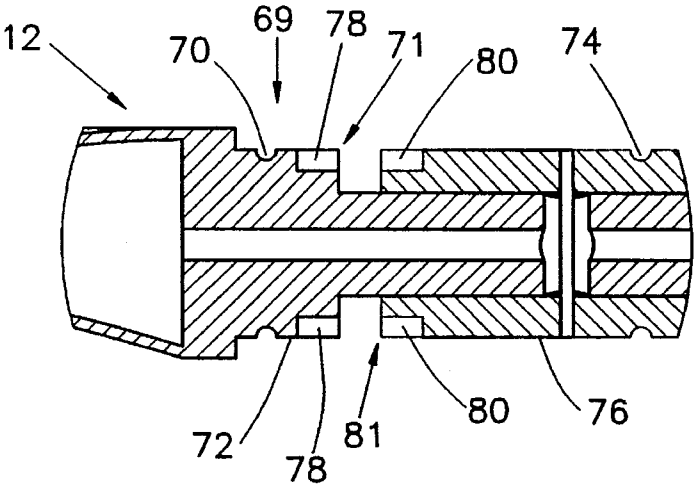
FIG. 4C is an enlarged section of part of the apparatus of FIGS. 4A and 4B.

Reference is now made to FIG. 4C, which is an enlarged section of part of the apparatus illustrated in FIGS. 4A and 4B. Reference is also made to FIG. 4D which is a perspective drawing of the part of the apparatus illustrated in FIG. 4C. In FIGS. 4C and 4D the rubber spring 50 is not shown for the sake of clarity.

The brush head portion 12 may be formed with a shoulder section 69 adjacent a handle end 71 of the brush head portion 12. The shoulder section 69 may be formed by a first cylindrical surface 72. A first semi-circular groove 70 may be formed in the shoulder section 69 extending circumferentially around the first cylindrical surface 72. At least a pair of first slots 78 may be formed in the shoulder section 69 adjacent the handle end 71.

The handle portion 10 may be formed with a second cylindrical surface 76 adjacent a brush end 81 of the handle portion 10. A second semi-circular groove 74, of substantially the same dimensions as the first semi-circular groove 70, may be formed on the second cylindrical surface 76, extending circumferentially around the second cylindrical surface 76 and proxal the brush end 81. At least a pair of second slots 80, of substantially the same dimensions as the first slots 78, may be formed adjacent the brush end 81 of handle portion 10.

Figure 5B:
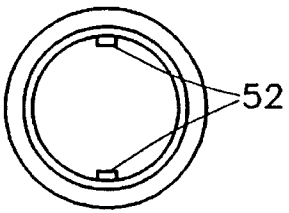
FIG. 5A and 5B are simplified illustrations showing respectively a side view and end view of part of the apparatus of FIGS. 4A and 4B.
Figure 5A:
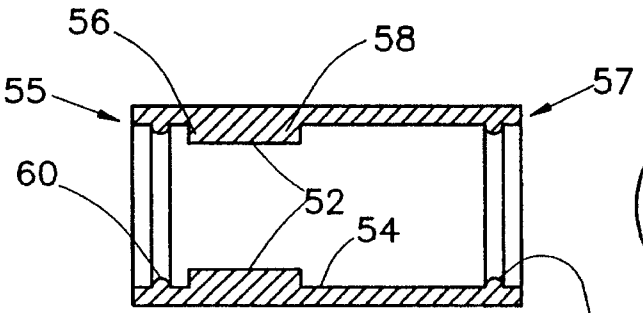

Reference is now made to FIG. 5A, which is a simplified cross sectional view of the rubber spring 50, and to FIG. 5B, which is a simplified end view of the rubber spring 50.

Rubber spring 50 may be formed with a first semicircular ridge 60, proxal a shoulder end 55 of the rubber spring 50 and extending inwards from an inside rubber cylindrical surface 54 and circumferentially around the rubber cylindrical surface 54. Rubber spring 50 may also be formed with a second semi-circular ridge 62, of substantially the same dimensions as the first semi-circular ridge 60, proxal a pin end 57 of rubber spring 50 and extending circumferentially around the rubber cylindrical surface 54.

The rubber spring 50 may also be formed with at least a pair of tongues 52 extending inwards from the rubber cylindrical surface 54. The tongues 52 extend axially from a brush slot end 56 proxal the first semi-circular ridge 60 to a handle slot end 58 distal the first semi-circular ridge 60.

When the rubber spring 50 is assembled onto the shoulder section 69, the first semi-circular ridge 60 will engage the first semi-circular groove 70 and the brush slot end 56 of the tongues 52 will engage the first slots 78. The dimensions of the first semi-circular ridge 60 and the first semi-circular groove 70 are such the axial position of the rubber spring 50 with respect to the brush head portion 12 is substantially determined and that relative motion in the direction of the longitudinal axis 14 is substantially prevented. The dimensions of the tongues 52 and the first slots 78 are such that relative motion between the rubber spring 50 and the brush head portion 12 in the rotational direction around the longitudinal axis 14 is substantially prevented.

When the rubber spring 50 and the brush head portion 12 are assembled onto the handle portion 10 the second semi-circular ridge 62 will engage the second semi-circular groove 74 and the handle slot end 58 of the tongues 52 will engage the second slots 80. The dimension of the second semi-circular ridge 62 and the second semi-circular groove 74 are such that the axial position of the rubber spring 50 with respect to the handle portion 10 is substantially determined and that relative motion in the direction of the longitudinal axis 14 is substantially prevented. The dimensions of the tongues 52 and the second slots 80 are such that relative motion between the rubber spring 50 and the handle portion 10 in the rotational direction around the longitudinal axis 14 is substantially prevented.

The distance between the first semi-circular ridge 60 and the second semi-circular ridge 62 are such that the pin 38 is centered relative to the bore 36 in the absence of the forces produced by rotation of the eccentric weight 30 and other external forces.

It will be appreciated that the rubber spring 50 is substantially fixed at the shoulder end 55 to the brush head portion 12 and at the pin end 57 to the handle portion 10.

The distance between the handle end 71 of the shoulder section 69 and the brush end 81 of the handle portion 10 are such that the elastic properties of the rubber spring 50 are operative to absorb vibration forces produced by the vibrating brush head portion 12 and at least partially preventing them from being applied to the handle portion 10.

The dimensions of the first and second semi-circular ridges 60 and 62 and the first and second semi-circular grooves 70 and 74 are such that the rubber spring 50 is operative to prevent the intrusion of liquids and other foreign matter into the brush head portion 12 and the handle portion 10.

It will be appreciated by persons skilled in the art that the present invention is not limited by what has been particularly shown and described hereinabove. The present invention is intended to cover modifications and variations of the structures shown and described hereinabove as well as mechanical structures which provide equivalent or similar operational results. The invention is thus limited only by the claims which follow:

We claim:

1. An electrically powered vibrating hair brush comprising:

an electric vibratory drive;

a handle portion; and a brush head portion, driven by the vibratory drive, the brush head portion comprising a base portion which lies generally in a plane and a multiplicity of bristles which extend outwardly from the base portion, generally perpendicular to the plane, said brush head portion being non-fixedly mounted onto the handle portion about a longitudinal axis, so as to permit both relative axial movement along said longitudinal axis and relative rotational movement thereabout, said electric vibratory drive being operative to provide vibration of the brush head portion both in the plane and in a plane perpendicular thereto and perpendicular to the longitudinal axis.

2. An electrically powered vibrating hair brush according to claim 1 and wherein said electric vibratory drive comprises a rotating eccentric drive operative to produce travel of the brush head portion relative to the handle portion along a three-dimensional travel path.

3. An electrically powered vibrating hair brush according to claim 1 and also comprising an electrical power source located in the handle portion.

4. An electrically powered vibrating hair brush according to claim 1 and also comprising an electrical power source located in the brush head portion.

5. An electrically powered vibrating hair brush according to claim 1 and also comprising a biasing apparatus disposed between said brush head portion and said handle portion for absorbing vibration forces produced by the vibrating brush head portion and at least partially preventing the vibration forces from being applied to the handle portion.

6. An electrically powered vibrating hair brush according to claim 5 and wherein said biasing apparatus is attached at one end to said brush head portion and attached at the other end to said handle portion.

7. An electrically powered vibrating hair brush according to claim 5 and wherein said biasing apparatus comprises a spring.

8. An electrically powered vibrating hair brush according to claim 7 and wherein said spring comprises an elastomeric material.

9. An electrically powered vibrating hair brush according to claim 1 and also comprising a relative displacement limiter for limiting at least one of the relative axial movement along said longitudinal axis and the relative rotational movement thereabout.

10. An electrically powered vibrating hair brush according to claim 1 and also comprising a relative displacement limiter for limiting both of the relative axial movement along said longitudinal axis and relative rotational movement thereabout.

11. An electrically powered vibrating hair brush according to claim 10 and wherein said biasing apparatus is operative to center said relative displacement limiter in the absence of said vibration forces,

12. An electrically powered vibrating hair brush according to claim 1 and wherein said biasing element is operative to absorb said vibration forces and said relative displacement limiter is operative for limiting at least one of the relative axial movement along said longitudinal axis and the relative rotational motion thereabout,

13. An electrically powered vibrating hair brush according to claim 1 and wherein said biasing element is operative to absorb said vibration forces and to center said relative displacement limiter in the absence of said vibration forces and said relative displacement limiter is operative for limiting at least one of the relative axial movement along said longitudinal axis and the relative rotational motion thereabout.

14. An electrically powered vibrating hair brush comprising:

an electric vibratory drive;

a handle portion; and a brush head portion, driven by the vibratory drive, the brush head portion being non-fixedly mounted onto the handle portion about a longitudinal axis, so as to permit both relative axial movement along said longitudinal axis and relative rotational movement thereabout, wherein said electric vibratory drive comprises a rotating eccentric drive operative to produce travel of the brush head portion relative to the handle portion along a three-dimensional travel path, and wherein said rotating eccentric drive has an axis of rotation which substantially intersects the longitudinal axis.

15. An electrically powered vibrating hair brush comprising:

an electric vibratory drive;

a handle portion; and a brush head portion, driven by the vibratory drive, biasing apparatus, comprising a helical spring, disposed between said brush head portion and said handle portion for absorbing vibration forces produced by the vibratory drive and at least partially preventing the vibration forces from being applied to the handle portion, the brush head portion being non-fixedly mounted onto the handle portion about a longitudinal axis, so as to permit both relative axial movement along said longitudinal axis and relative rotational movement thereabout.

* * * * *